US005921718A

United States Patent [19]

Kolk

[11] Patent Number: 5,921,718

[45] Date of Patent: Jul. 13, 1999

[54] PROP FOR USE IN UNDERGROUND MINING OR TUNNEL CONSTRUCTION

[76] Inventor: Theodor Kolk, Blickpunkt 21, Haltern-Sythen, Germany, D-45721

[21] Appl. No.: 08/875,643

[22] PCT Filed: Apr. 19, 1996

[86] PCT No.: PCT/EP96/01634

§ 371 Date: Jul. 31, 1997

§ 102(e) Date: Jul. 31, 1997

[87] PCT Pub. No.: WO96/33336

PCT Pub. Date: Oct. 24, 1996

[30] Foreign Application Priority Data

Apr. 20, 1995 [DE] Germany ..... 195 14 137

[51] Int. Cl.[6] ..... E21D 25/14; E21D 23/04

[52] U.S. Cl. ..... 405/290; 248/354.2; 405/288

[58] Field of Search ..... 405/288, 289, 405/290, 229, 230; 248/354.2, 354.1, 354.3

[56] References Cited

U.S. PATENT DOCUMENTS

| | | | |
|---|---|---|---|
| 4,167,361 | 9/1979 | Petro et al. | 405/289 X |
| 5,143,340 | 9/1992 | Wood et al. | 405/289 |
| 5,413,436 | 5/1995 | Merz | 405/290 |
| 5,564,867 | 10/1996 | Domanski et al. | 405/290 |
| 5,720,581 | 2/1998 | Dacon et al. | 405/288 |

FOREIGN PATENT DOCUMENTS

| | | |
|---|---|---|
| 1073420 | 1/1960 | Germany . |
| 1156736 | 11/1963 | Germany . |
| 4115209A1 | 11/1992 | Germany . |
| 4221941A1 | 1/1994 | Germany . |
| 4224852A1 | 2/1994 | Germany . |
| 4338830C1 | 5/1995 | Germany . |
| 2100318 | 12/1982 | United Kingdom . |
| WO 91/00416 | 1/1991 | WIPO . |
| WO 94/27029 | 11/1994 | WIPO . |

*Primary Examiner*—Dennis L. Taylor
*Attorney, Agent, or Firm*—Collard & Roe, P.C.

[57] ABSTRACT

An extending prop for underground and tunnel construction, comprising, an outer tube having a closed bottom end, an inner tube telescopically slidable in the outer tube and having a closed top end, and a mechanical locking device adapted to fix the relative positions of the inner and outer tubes. A hydraulically actuated flying piston is arranged in the outer tube and is separated from the inner tube. The piston is adapted to extend the inner tube upon actuation by hydraulic pressure. The piston divides the prop into a bottom chamber enclosed by the outer tube and a top chamber enclosed by the inner tube. A first filling connection is arranged on the outer tube for filling the bottom chamber with a pressure medium for actuating the piston. A second filling connection is arranged on the inner tube for filling the top chamber. The prop is fillable with construction material through the second filling connection over its entire length by displacement of the piston toward the bottom end of the the outer tube.

16 Claims, 12 Drawing Sheets

PROP FOR USE IN UNDERGROUND MINING OR TUNNEL CONSTRUCTION

BACKGROUND OF THE INVENTION

1. Field of the Invention

The invention relates to an extending prop for underground mining or tunnel construction, consisting of two telescopic tubes which are closed at their free ends and designed to be braced against the rock by means of a hydraulically operating prop-extending device, with provision being made between said tubes for a locking device, by which the inner tube can be mechanically fixed on the outer tube at different lengths of extension, whereby the interior spaces of the extending prop can be filled with construction material while the extension load is being maintained.

2. The Prior Art

Such extending props filled with construction material are now frequently used instead of the wooden props or individual hydraulic props employed in the past. The advantage is that such props, given their lightweight construction, are capable of generating very high forces of support. Since the tubes substantially only serve as tension-resistant sleeves for the largely compression-resistant construction material, their steel construction can be designed with consequent application of the design principles of lightweight engineering. Simple welded tubes made of inexpensive structural steel can be used because stressing of the tubes is not critical. The weight of the props is very light as long as the tubes are still empty, so that they can be easily transported and handled at the site of installation. Because of the lightweight design and inexpensive manufacture made possible by such a design, said props, as opposed to individual hydraulic props, can be used as so-called "lost expansion" which, after it has been used, for example in the brace/gallery transition zone, can be left standing without problems in the packing space. Such lost expansion within the zone of the edge of the gallery, furthermore, offers advantages in view of the future stability of the gallery.

Such a prop filled with construction material is known, for example from DE-PS 41 15 209. Before the construction material is filled, said known prop uses for bracing a plurality of hydraulic clamping cylinders, which are attached to the outer and inner tubes from the outside for displacing the inner tube against the outer tube. In the extended position, the inner tube is locked on the outer tube in the given position of extension by a locking device. The hydraulic clamping cylinders then can be removed. Subsequently, the prop so braced against the rock is filled with construction material.

The known prop of said type has drawbacks in various respects. On the one hand, handling of the hydraulic clamping cylinders is extremely complicated and labor-intensive. Each of said heavy clamping cylinders has to be lifted by hand, attached to the prop, and then removed again from the latter after bracing has been completed. On the other hand, possibilities have to be available for connecting the cylinders with a high-pressure hydraulic system, for example a connection with the bracing hydraulics. Furthermore, the flow of forces obtained is unfavorable because of the lateral attachment of the clamping cylinders. In addition, the extent of telescoping is relatively limited.

Finally, another drawback is that the prop can absorb only low forces until it is filled with construction material, because the mechanical locking device always first requires a certain amount of insertion of the inner tube against the outer tube before it is capable of absorbing notable forces.

The known props, therefore, are not sufficiently bearing in the early stage and require a relatively large amount of convergence before developing their full supporting force.

The older DE 43 38 830 Cl—which was not published at an earlier date—discloses a similar extending prop, in which the inner end of the inner tube is designed closed, forming in this way a piston that is guided sealed in the outer tube. The interior space of the extending prop is divided by such cylinder in two chambers, which both can be filled with construction material, for example with compressible foamed concrete. With said extending prop, however, the piston does not serve the purpose of setting the prop with high setting load, but for obtaining in cooperation with the compressible filling material a defined yieldingness of the prop. For extension, said known prop uses a prop extension mechanics, which is located at the insertion end of the outer tube and fixable on the inner tube with vertical adjustability. No high extension loads can be achieved with said mechanical prop extension device. Furthermore, it is not possible to achieve high extension loads by filling the interior spaces of the prop with expanding foam material because the latter is compressible and, consequently, not capable of generating any high extension load.

An extending prop is known also from WO 94/27029, which consists of two telescopic tubes which are closed at the ends facing away from each other. The tubes can be hydraulically braced against the rock and fixed on each other with a locking device at different lengths of extension. The outer tube and the inner tube enclose a chamber, which can be acted upon via a filling connection by pressure medium, whereby the inner tube is extended from the outer tube, i.e., the extending prop is set. However, the interior spaces of this known prop cannot be filled with construction material, which means that the advantages of this special technology are not exploited.

The problem of the invention is to create an extending prop of the type specified above, which can be handled in a simple way, extended hydraulically with high extension load; which has immediate or at least early bearing characteristics, and which can be filled with construction material over its entire length.

SUMMARY OF THE INVENTION

The object of the invention is an extending prop for underground mining and tunnel construction, consisting of an inner tube and an outer tube, such tubes being designed closed at their free ends and telescopic and being fixable against each other at different lengths of extension by means of a mechanical locking device, whereby a piston acted upon hydraulically by extension pressure is arranged in the outer tube, such piston acting upon the inner tube in the sense of extension and being designed as a flying structural component separated from the inner tube and dividing the interior space of the extending prop in a first chamber (bottom chamber) located beneath the piston, and a second chamber (top chamber) located above the piston, whereby a first filling connection is associated with the first chamber (bottom chamber), via which said chamber can be acted upon by a pressure medium under extension pressure, and a second filling connection is associated with the second chamber (top chamber), via which the extending prop can be filled over its entire length with construction material by displacement of the flying piston up to the end of the outer tube.

The extending prop according to the invention has the advantage, first of all, that extension and bracing against the rock are extremely simple operations. For said purposes, only the bottom chamber of the extending prop is acted upon by a suitable hydraulic pressure medium. Primarily water from the low-pressure water pipeline—which is available underground, as a rule—is suitable for said purpose. Such pipeline usually carries water under a pressure of 40 bar, which, in view of the large diameter of the outer tube, suffices for generating a substantial extension force. The operations taking place during the extension process are as simple as with individual hydraulic props. Especially complicated manipulation of separate extending cylinders is dispensed with. Like an individual hydraulic prop, the extending prop so set is distinctly early bearing and thus puts up considerable supporting force against the starting convergence from the start. After a certain amount of convergence has occurred, the mechanical locking device develops its full supporting force, so that the pressure medium loading the piston can be discharged and the prop can be filled with construction material via the second filling connection. In this process, the flying piston is pushed back to any desired extent, if necessary to the bottom of the outer tube. During said filling operation, the inner tube is fixed on the outer tube by means of the mechanical locking device. By filling the extending prop with construction material over any desired length, it is possible to influence the support behavior of the prop within wide limits without requiring any additional technical expenditure.

According to a particularly advantageous embodiment of the extending prop according to the invention, provision is made that the mechanical locking device consists of two telescopic ring wedge elements arranged between the lower end of the inner tube and the piston. One of said two elements is radially spreadable apart when the two elements are pushed one into the other, plastically expanding the outer tube. Such design of the mechanical locking device results in an early bearing and highly load-carrying mechanical connection between the inner and the outer tube. A special advantage of such mechanical connection is that the inner tube remains displaceable against the outer tube over a relatively great distance while maintaining a very high extension load. The outer tube is plastically widened in this connection across the length of the sink-in path. Such plastic widening is visible on the extending prop from the outside and tells the miner that a certain amount of convergence has already occurred on the respective prop.

So as to avoid that the variation of the locking device discussed above is activated too early when the prop is extended, for example because resistances have to be overcome when the prop is pushed out, provision is made, furthermore, that the wedge surfaces of the ring wedge elements and/or counter ring wedge elements are fitted with projections that can be sheared off at a preset extension load. Such projections release displacement of the wedge surfaces against each other only when the preset extension load is exceeded.

Alternatively, the locking device can be designed in the form of an expanding spring ring arranged on the lower end of the inner tube, such spring ring being elastically pretensioned in the radial direction and designed in such a way that it permits extension movement of the inner tube relative to the outer tube, but expands in the radial direction in the presence of a retraction movement, in a way such that a friction grip and/or positively locked connection connection with the outer tube is produced.

Furthermore, the locking device may have a ring wedge fixable on the outer circumference of the inner tube, such ring wedge being insertable in the outer tube from the top, expanding the latter. Such a locking device is yielding across a very great distance of movement as well, while high supporting force is maintained, and permits providing the extending prop with a suitable support characteristic.

With the last-mentioned design of the locking device, the ring wedge is usefully fitted on its inner circumference with means increasing the friction between the ring wedge and the inner tube. In this way, the ring wedge locks itself on the inner tube in the axial direction, so that yieldingness of the locking device is primarily supplied by plastic expansion of the outer tube.

Furthermore, with said embodiment of the locking device, provision is made for a ring made of elastic, pretensioned material, such ring resting against the top side of the ring wedge and in turn being supported on the upper end of the outer tube and pushing the ring wedge downwardly in the axial direction. This assures that when convergence starts, the ring wedge immediately absorbs the expansion of the outer tube. This means that the extending prop develops the full supporting force within the zone of the locking device already after a relatively short distance of sink-in.

The piston used for the prop according to the invention usefully consists of elastically and/or pladtically yielding material, in particular plastic, and has an annular lip seal snugly fitted against the wall of the outer tube, and is mounted on the bottom of a pot-like, stiff guiding element. Such a piston can be manufactured at very low cost and is adequately resistant to weat for the one-time use of the extending prop.

A pressure-limiting valve can be usefully associated with the bottom chamber. Such pressure-limiting valve—which is basically known from hydraulic props—offers the advantage that, in combination with the flying piston, the prop can be filled, if necessary, with construction material over the entire length while the pressure prevailing in the bottom chamber is being maintained. However, this requires a construction material pump for supplying the construction material to be fed into the top chamber at a pressure slightly greater than the opening pressure of the pressure-limiting valve.

Special benefits are gained if a bursting disk serving as the pressure-limiting means is associated with the bottom chamber. Such bursting disk, like the pressure-limiting valve, responds when a defined pressure is exceeded. Such pressure occurs after convergence has progressed accordingly and the extending prop is loaded to an extent such that the mechanical locking device develops its full supporting force. The broken bursting disk tells the miner on site that he can now fill this extending prop with construction material.

In order to further favorably influence the support properties of the extending prop according to the invention, elastic, compressible elements can be arranged in the bottom chamber, particularly elements in the form of air-filled hollow bodies, or foam bodies. In this way, the bottom chamber is provided with exactly preselectable properties until the full supporting force clicks in. The support properties of the extending prop can be changed in any desired way by filling such bodies to a greater or lesser extent.

For the last-mentioned purpose, the extending prop can be fitted, if necessary, with axially compressible spring elements arranged on the foot or head side.

So as to limit the amount of extension of the prop according to the invention, the wall of the outer tube is provided with bores spaced from the top end of the outer tube, such bores serving as stroke-limiting means. When the piston travels across said bores, the latter connect the bottom chamber with the atmosphere. Such limitation of the stroke is achieved in a particularly advantageous way without stop means, which would require much more complicated working of the tubes.

Finally, provision is made for fitting the walls of the inner and outer tubes within the zone of overlap with dewatering bores, which supplement or support the dewatering device located in the head of the prop. The dewatering bores permit water to exit from the filled construction material. Such withdrawal of excess water is important, so that the construction material can form a supporting column and, if necessary, set the latter.

The dewatering bores of the outer tube are usefully covered by a fabric that is permeable to water and, at the same time, retains the construction material. In this way, the annular space between the inner and outer tubes is still filled with construction material, whereas construction material is at the same time prevented from exiting from the extending prop via the dewatering bores.

Finally, according to an advantageous further development of the extending prop according to the invention, provision is made that the outer tube and the inner tube are arranged in the interior of a jacketing consisting of two tubes, which are plugged one into the other and telescopically guided in one another, such jacketing having a larger diameter than the prop across its entire length, whereby the annular space between the extending prop and the jacketing can be filled with construction material. It is possible in this way to further develop the prop according to the invention into a prop with very high bearing capacity, such prop being capable of absorbing extremely high loads. Such an extending prop with such jacketing can be used, for example for supporting bridge panels in gallery intersections or the like. The jacketing may have practically any desired diameter, so that supporting forces of any desired magnitude can be obtained. Due to the fact that the prop of the invention is arranged in the interior of the jacketing, this load-bearing prop, too, can be braced with high force between hanging and lying rock.

BRIEF DESCRIPTION OF THE DRAWINGS

Exemplified embodiments of the invention are explained in greater detail in the following by reference to the drawings, in which.

DETAILED DESCRIPTION OF THE PREFERRED EMBODIMENTS

Figure 1:
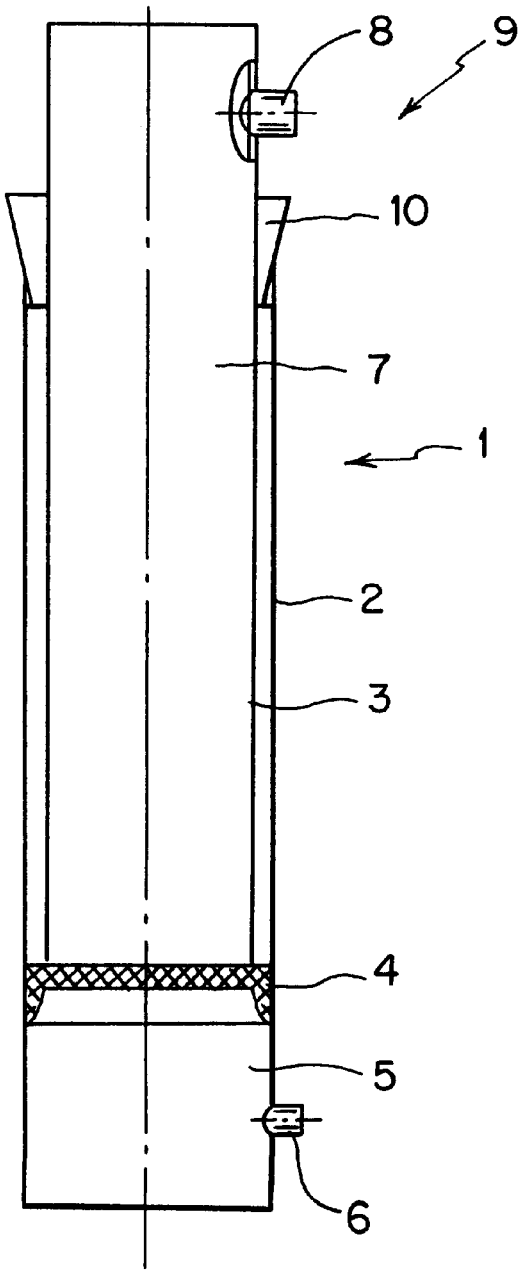
FIG. 1 shows a schematic view of the extending prop of the invention by a longitudinal section, without pressure medium and construction material.
Figure 3:
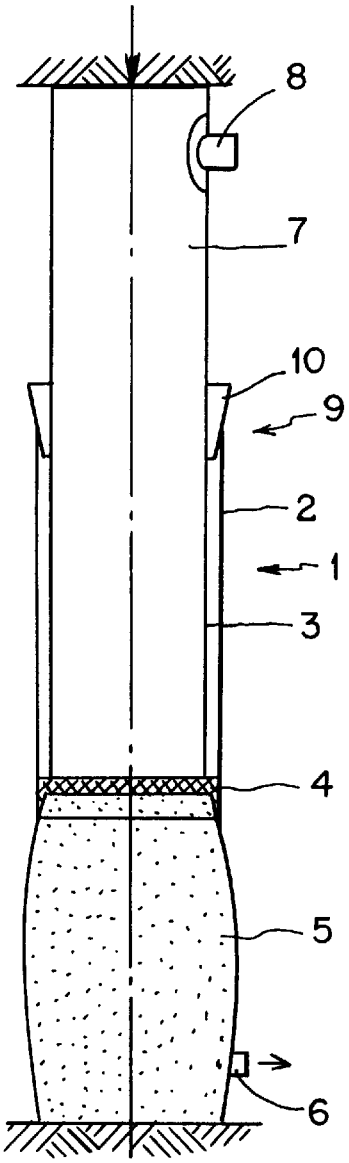
FIG. 3 shows the extending prop according to FIG. 1 as convergence starts.
Figure 4:
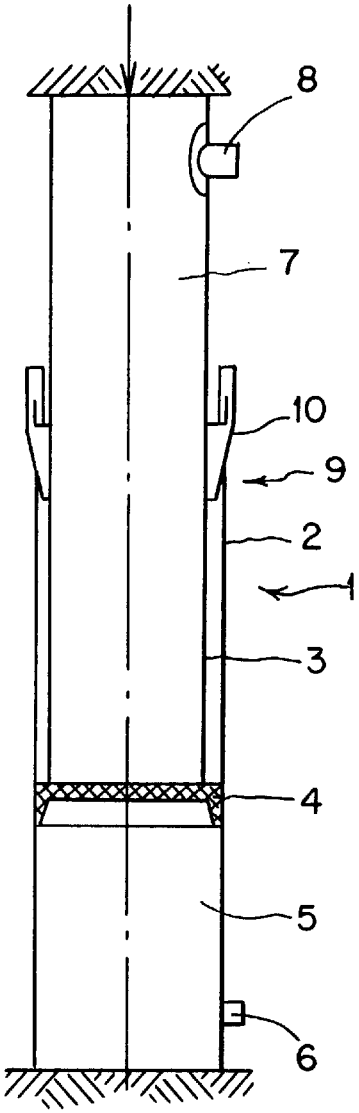
FIG. 4 shows the extending prop according to FIG. 1 prior to filling with construction material.

In FIG. 1, the extending prop in its totality is denoted by reference numeral 1. It consists of an outer tube 2, which is closed at the bottom and open at the top, in which an inner tube 3 is extendibly guided, said tube being open at the bottom and closed at the top. A piston 4 located at the lower end of inner tube 3 is sealingly guided in outer tube 2 and serves for pushing inner tube 3 out. A first chamber (bottom chamber 5) is locared beneath piston 4 in outer tube 2, said chamber being acted upon via a filling connection 6 by a suitable pressure medium, for example pressure water.

A second chamber (top chamber 7) is located above piston 4, said chamber being substantially formed by the inner tube 3 and having a filling connection 8 at the upper end.

Inner tube 3 is fixable on outer tube 2 by means of a locking device 9. Said locking device 9 has a ring wedge 10 fixable on the outer circumference of inner tube 3, said ring wedge being insertable in outer tube 2 from the top, expanding outer tube 2.

Piston 4 is designed as a flying piston, i.e., it is a structural elements separated from inner tube 3, resting supportingly against inner tube 3, supporting the latter from the bottom.

Figure 2:
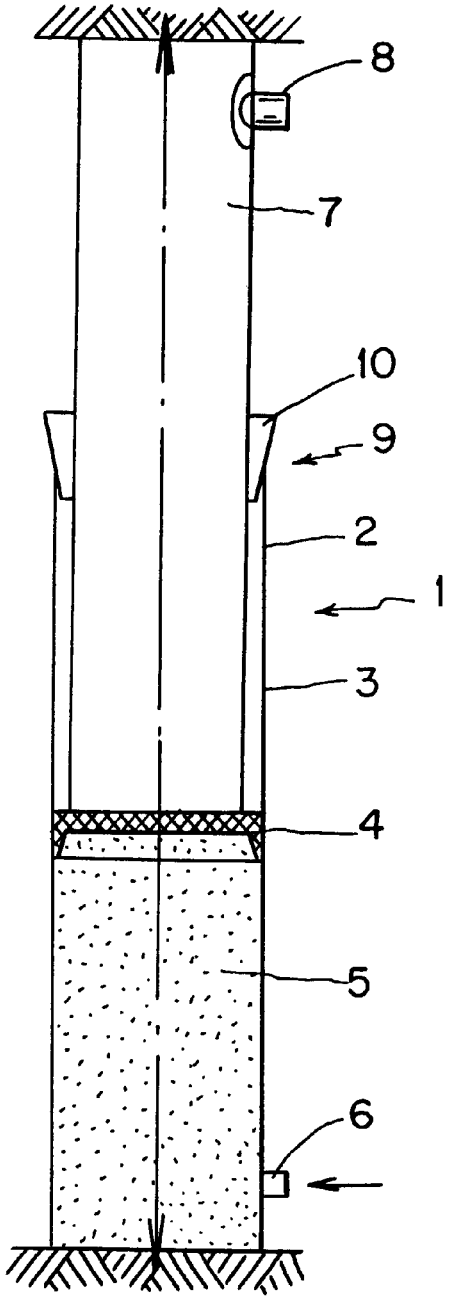
FIG. 2 shows the extending prop according to FIG. 1 in the course of the setting process.

Setting and filling of the extending prop shown in FIG. 1 is explained in the following in greater detail. As shown in FIG. 2, extending prop 1 is first between hanging lying rock. For said purpose, bottom chamber 5 is acted upon via filling connection 6 by a pressure medium suitable for the setting process, e.g. pressure water from a low-pressure water pipeline. Piston 4 is forced upwardly in this way, pushing inner tube 3 against the hanging material with relatively high setting force.

Filling connection 6 is subsequently shut off. When convergence starts, inner tube 3 is pushed downwardly with great force, so that outer tube 2 is slightly deformed elastically, i.e., it becomes slightly thicker under the the influence of the pressure prevailing in bottom chamber 5. As the depth of penetration increases, ring wedge 10 penetrates the top end of the outer tube and elastically expands the latter. Locking device 9 is gradually loaded in this way, to an extent such until it alone is capable of absorbing the required force of support. Bottom chamber 5 is subsequently drained. In this condition, the supporting force is solely generated by locking device 9.

Figure 5:
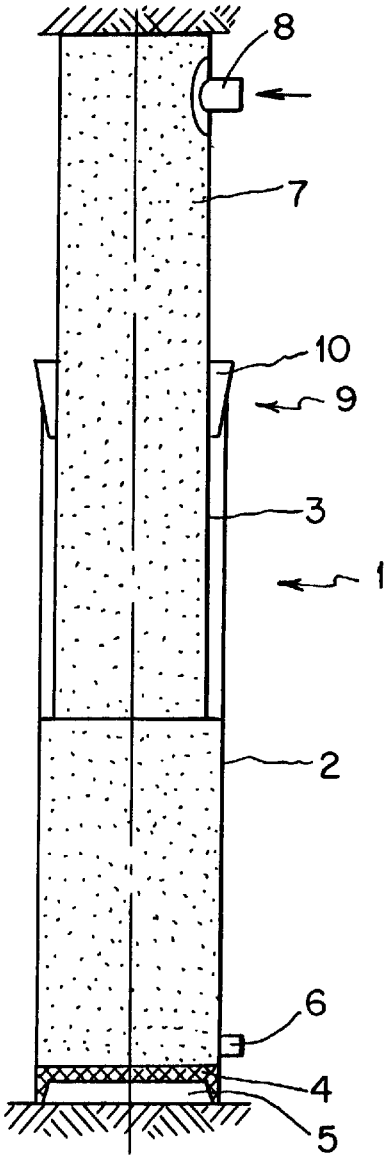
FIG. 5 shows the extending prop according to FIG. 1 after the filling with construction material.

For increasing the supporting force, the extending prop is now filled with construction material from the top via filling connection 8 (FIG. 5). In the course of filling with construction material from the top, the construction material forces piston 4 into the outer tube 2 down to the bottom of the latter, so that the extending prop is filled with construction material over its entire length. If only part of the length of the extending prop is to be filled with construction material in order to obtain a certain bearing behavior, the filling operation can be discontined at any time.

Filling with construction material can be carried out at any desired time as soon as the locking device 9 is bearing sufficiently. In this way, the bearing or supporting behavior of the extending prop of the invention can be adapted to the rock pressure and occurring convergences at any time. In any case, the miner has numerous possibilities still on site to influence the bearing behavior of the extending prop of the invention in said sense.

Figure 6:
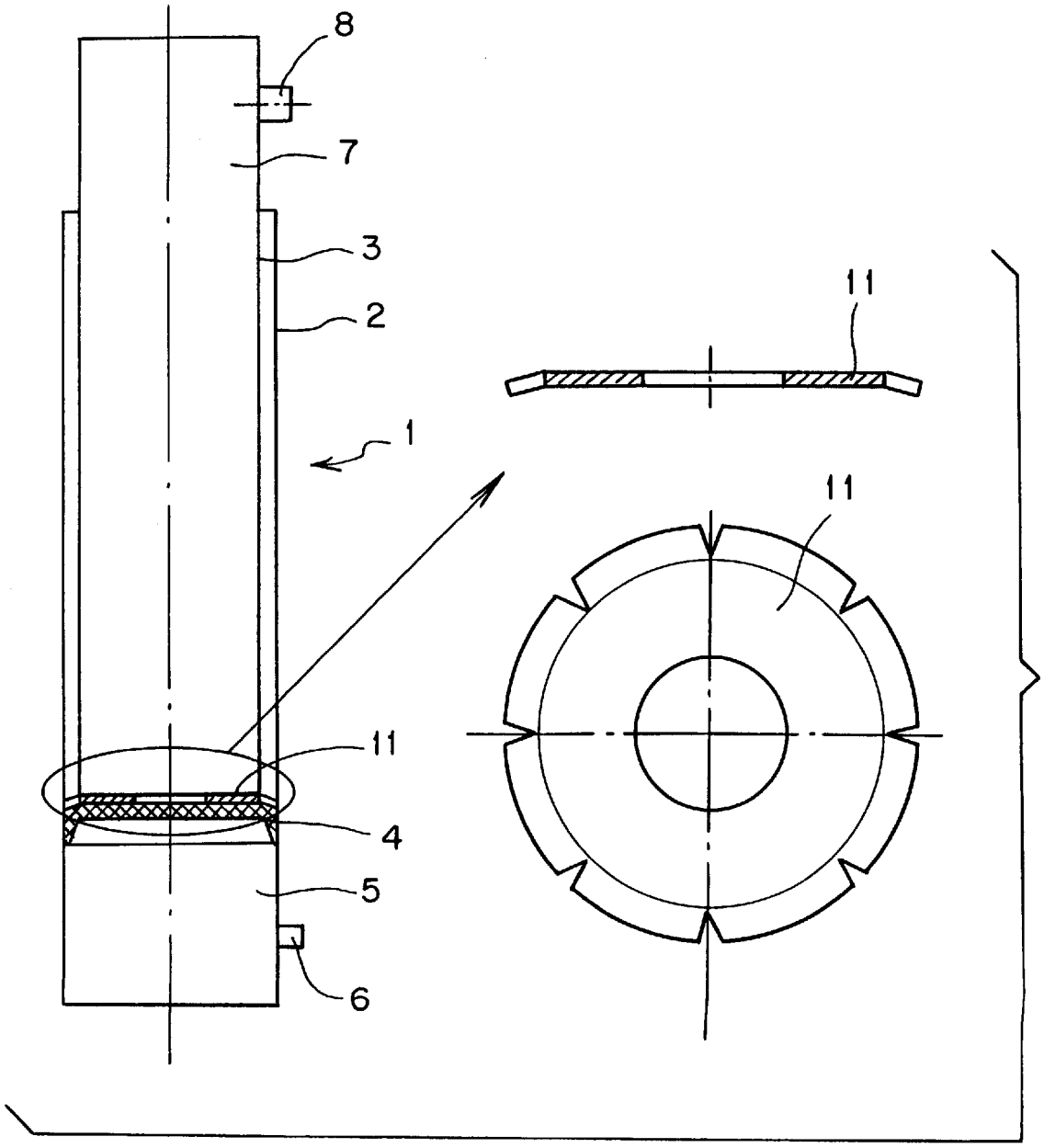
FIG. 6 shows an extending prop according to the invention with an expanding spring ring as locking device.

The exemplified embodiment of FIG. 6 largely corresponds with the exemplified embodiment according to FIG. 1. However, in the former, an expanding spring ring 11 is arranged at the lower end of inner tube 3, said spring ring being elastically pretensioned in the radial direction and resting with its elastic tongues against the inner wall of outer tube 2. The spring tongues are arranged in such a way that the inner tube together with the expanding spring ring 11 can be displaced upwardly, whereas displacement downwardly is not permitted by such rongues. When displaced downwardly, the tongues of the expanding spring ring spread in the radial direction in such a way that a friction grip or positive connection with outer tube 2 is produced.

Figure 9:
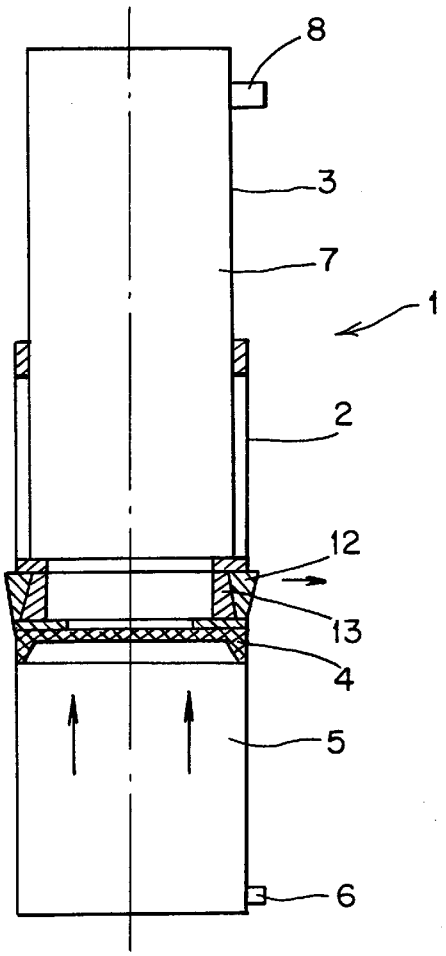
FIGS. 7, 8 and 9 show an extending prop according to the invention with another design of the locking device.
Figure 8:
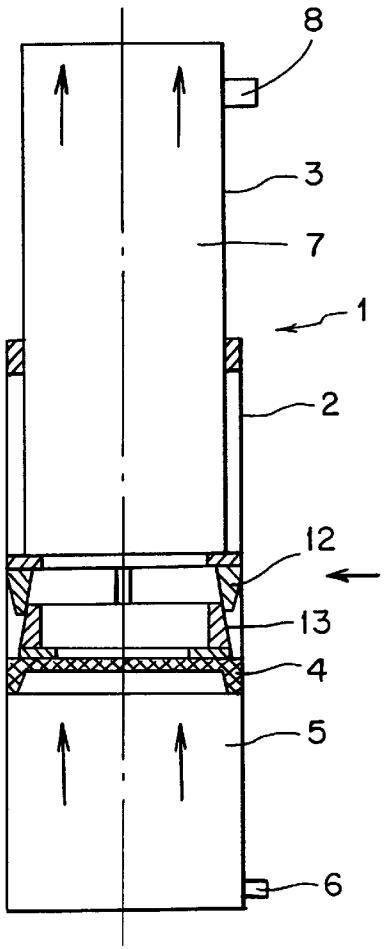
Figure 7:
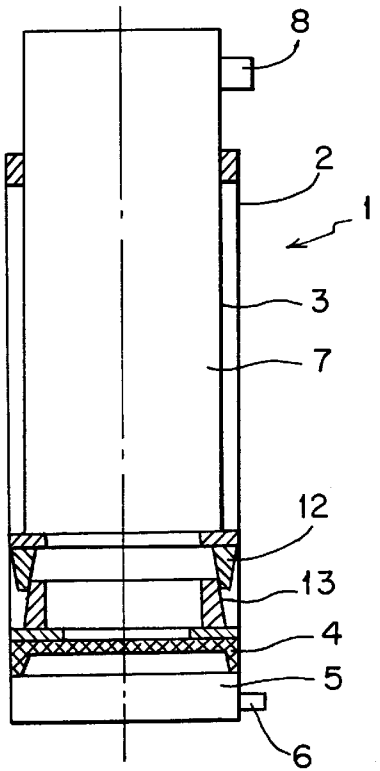

In the embodiment of the locking device shown in FIGS. 7, 8 and 9, inner tube 2 is fitted at its lower end with a radially expandable ring wedge element 12, into which a counter ring wedge element 13 located above piston 4 and supported on the latter is insertable from the bottom. When counter ring wedge element 13 is pushed into the radially spreadable ring wedge element 12 from the bottom, the latter expands, plastically expanding the outer tube 2, so that an extremely supportive connection with immediately bearing properties is obtained between inner tube 3 and outer tube 2.

Figure 10:
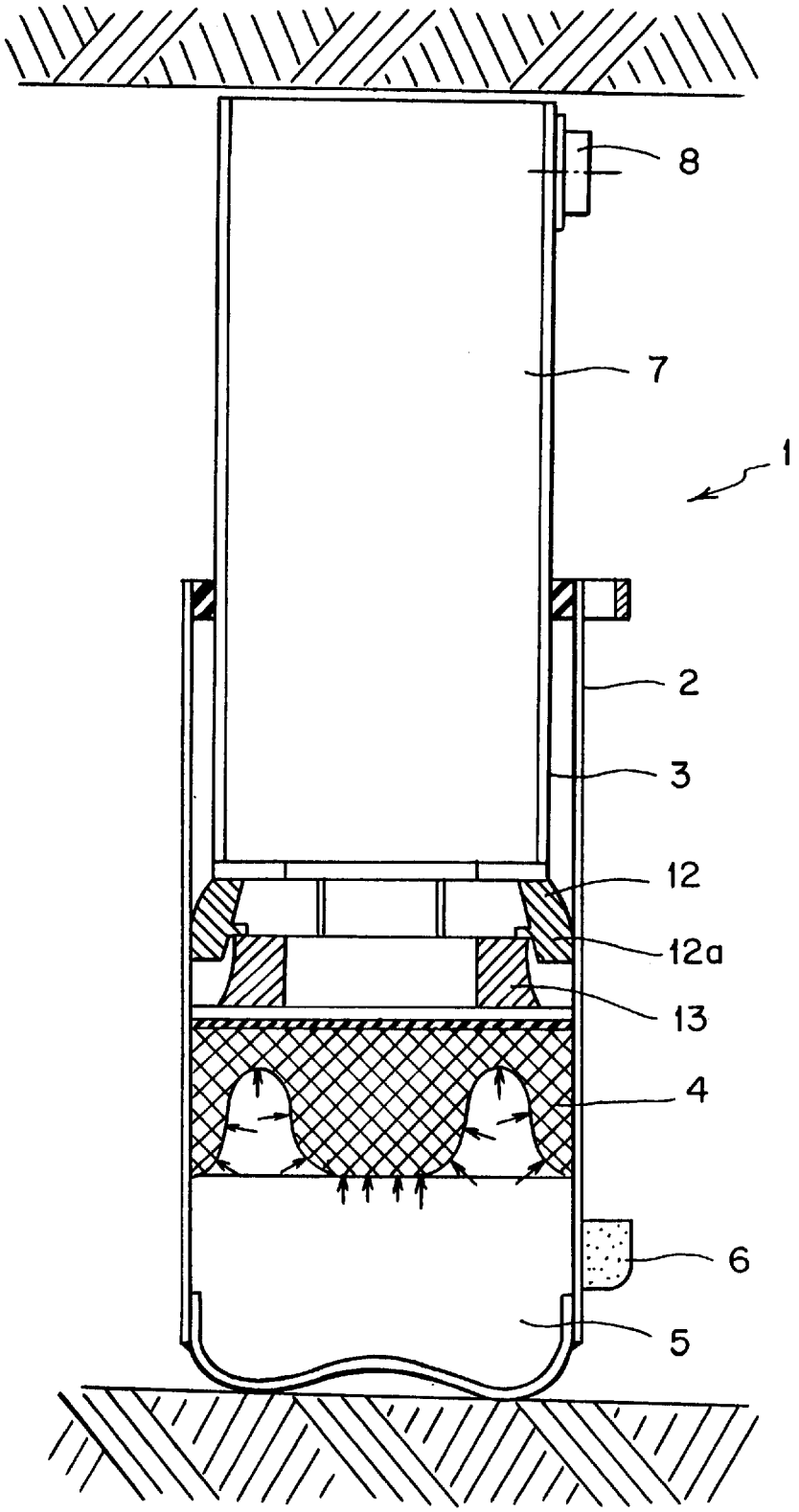
FIG. 10 shows a further development of the extending prop shown in FIGS. 7, 8 and 9.

With the embodiment according to FIG. 10, radially inwardly protruding projections 12*a*, which can be sheared off, are located on the wedge surfaces of ring wedge element 12. Said projections first have to be sheared off by the counter ring wedge element 13 before counter ring wedge element 13 can be pushed into ring wedge element 12. The size of the cuttable cross sections of projections 12*a* is selected in such a way that insertion of counter ring wedge element 13 into ring wedge element 12 can take place only when a predetermined, relatively high setting load is exceeded. For the same purpose, if necessary, provision can be made for corresponding cuttable projections on the wedge surfaces of counter ring wedge element 13 as well.

Figure 11:
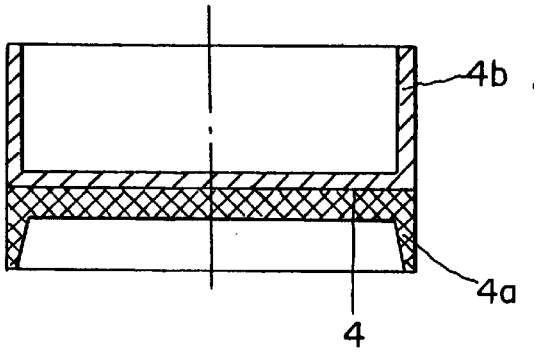
FIG. 11 shows a representation of a detail of the piston.

FIG. 11 shows a representation of a detail of piston 4. Said piston consists of elastically and/or plastically yielding material, particularly plastic, and has a ring lip 4*a* snugly fitting against the wall of the outer tube. Furthermore, piston 4 is mounted on the bottom of a pot-shaped, rigid guiding element 4*b* which, for example, is made of steel. Said guiding element 4*b* provides the piston with the required guidance and rigidity, whereas lip seals 4*a* provided for tightness. A piston so designed is, overall, inexpensive to manufacture and, therefore, especially suitable for one-time use.

Figure 12:
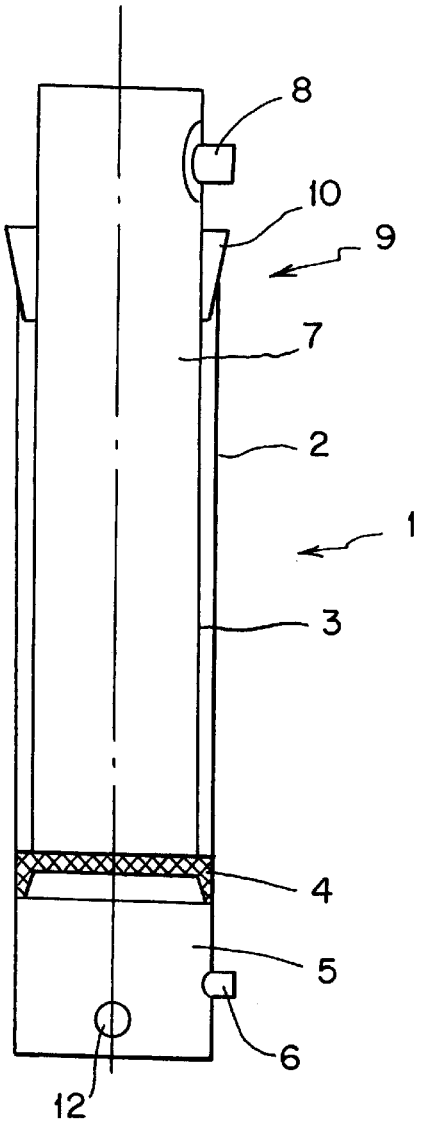
FIG. 12 shows an extending prop according to the invention with a bursting disk on the bottom chamber.

FIG. 12 shows an exemplified embodiment of the extending prop according to the invention, in which a bursting disk 14 serving as pressure limiter is associated with bottom chamber 5. Said bursting disk responds when loading of the extending prop has progressed to a point where locking device 9 is adequately bearing.

Figure 13:
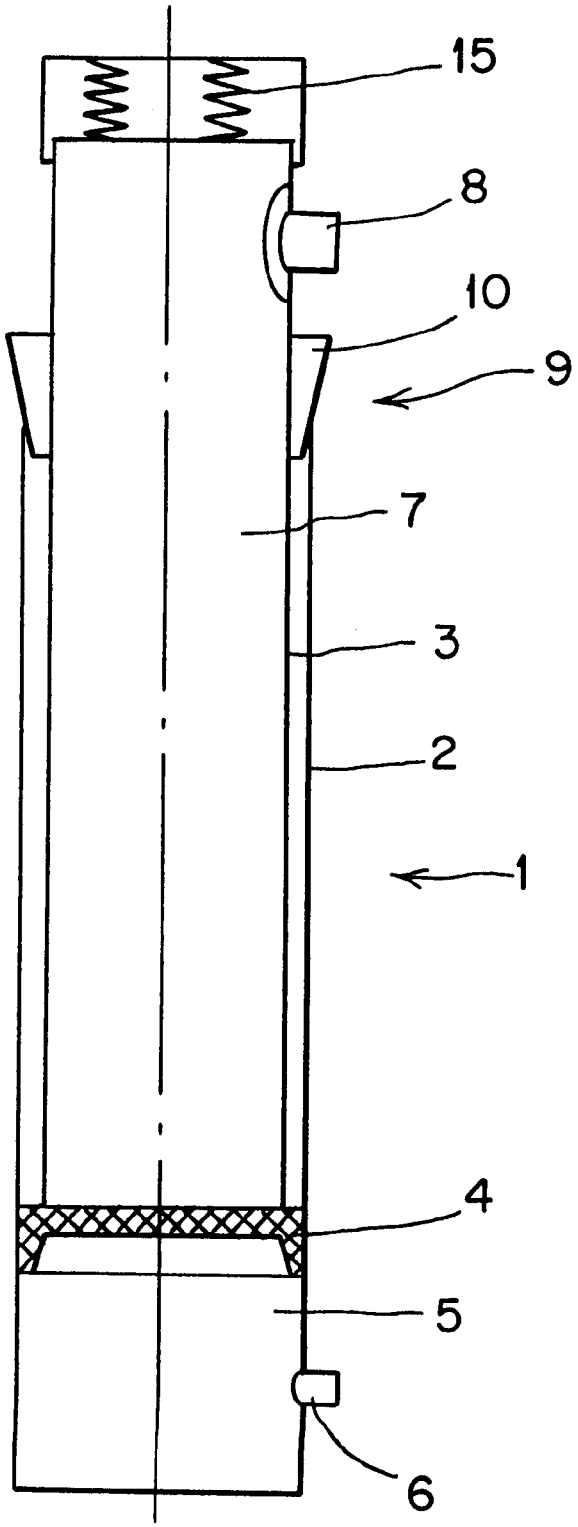
FIG. 13 shows an extending prop according to the invention with an elastic head part.

In the exemplified embodiment according to FIG. 13, inner tube 3 is fitted on the head side with the axially compressible spring elements 15. If necessary, such spring elements 15 can be arranged also on outer tube 2 on the foot side.

Figure 14:
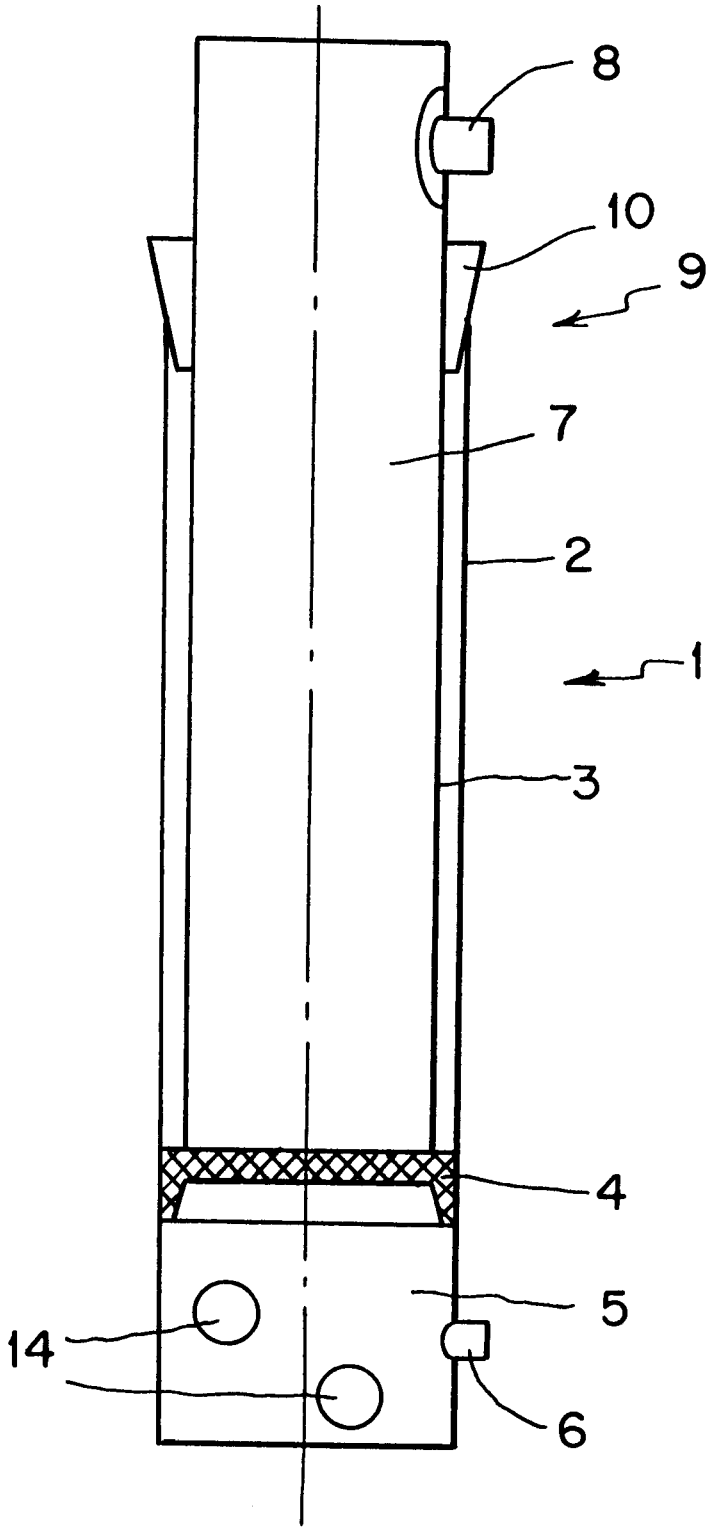
FIG. 14 shows an extending prop according to the invention with compressible hollow bodies in the bottom chamber.

FIG. 14 shows that elastically compressible hollow bodies particularly in the form of air-filled hollow bodies 14 or foam bodies can be arranged, if necessary, in bottom chamber 5. Such elastically compressible hollow bodies 14 effect additional elastic yieldingness of the extending prop.

Figure 15:
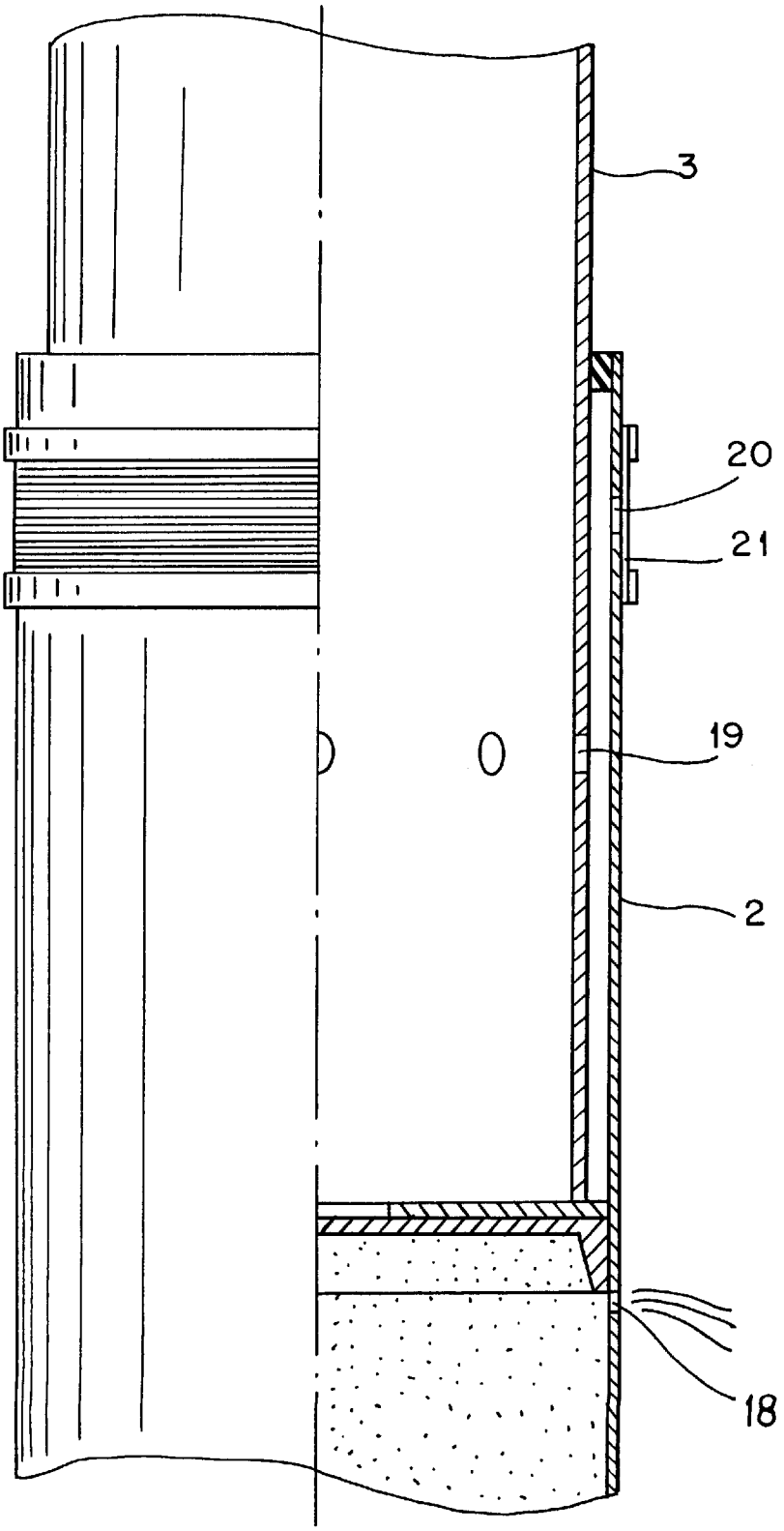
FIG. 15 shows an extending prop according to the invention with limitation of the stroke and dewatering bores.

FIG. 15 shows that provision is made in the wall of outer tube 2 for the bores 18, such bores being arranged spaced from the top end of the outer tube and serving as stroke-limiting means. Said bores connect bottom chamber 5 with the atmosphere when the piston travels across said bores. As soon as said connection is made, piston 4, of course, no longer can be moved upwardly further.

Furthermore, FIG. 15 shows the dewatering bores 19 in inner tube 3, and 20 in outer tube 2, such bores being located within the zone of overlap of inner tube 3 and outer tube 2. The dewatering bores 20 of outer tube 2 are covered on the outside by a fabric 21, which is permeable to water, but impermeable to construction material. In addition, the extending prop has, of course, also the usual dewatering device in the head of the prop.

Figure 16:
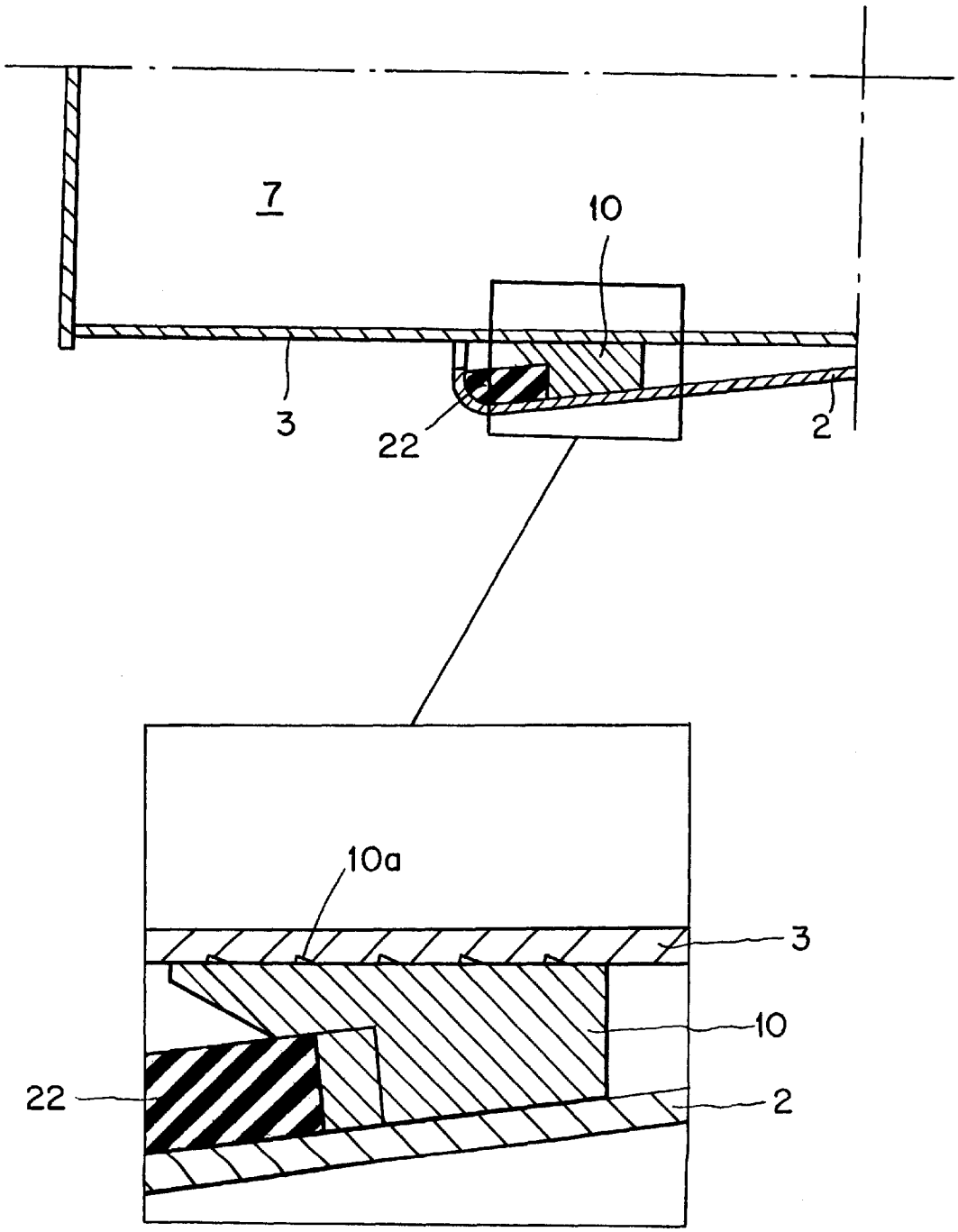
FIG. 16 shows detail representations of a locking device with ring wedges.

FIG. 16 shows a modified embodiment of locking device 9. Here, ring wedge 10 is fitted on its inner side with the sharp projections 10*a*, which engage the outer wall of inner tube 3. Furthermore, a ring 22 made of elastically pretensioned material is arranged above ring wedge 10, said ring itself being supported on the top end of outer tube 2 and pressing ring wedge 10 downwardly in the axial direction.

Figure 17:
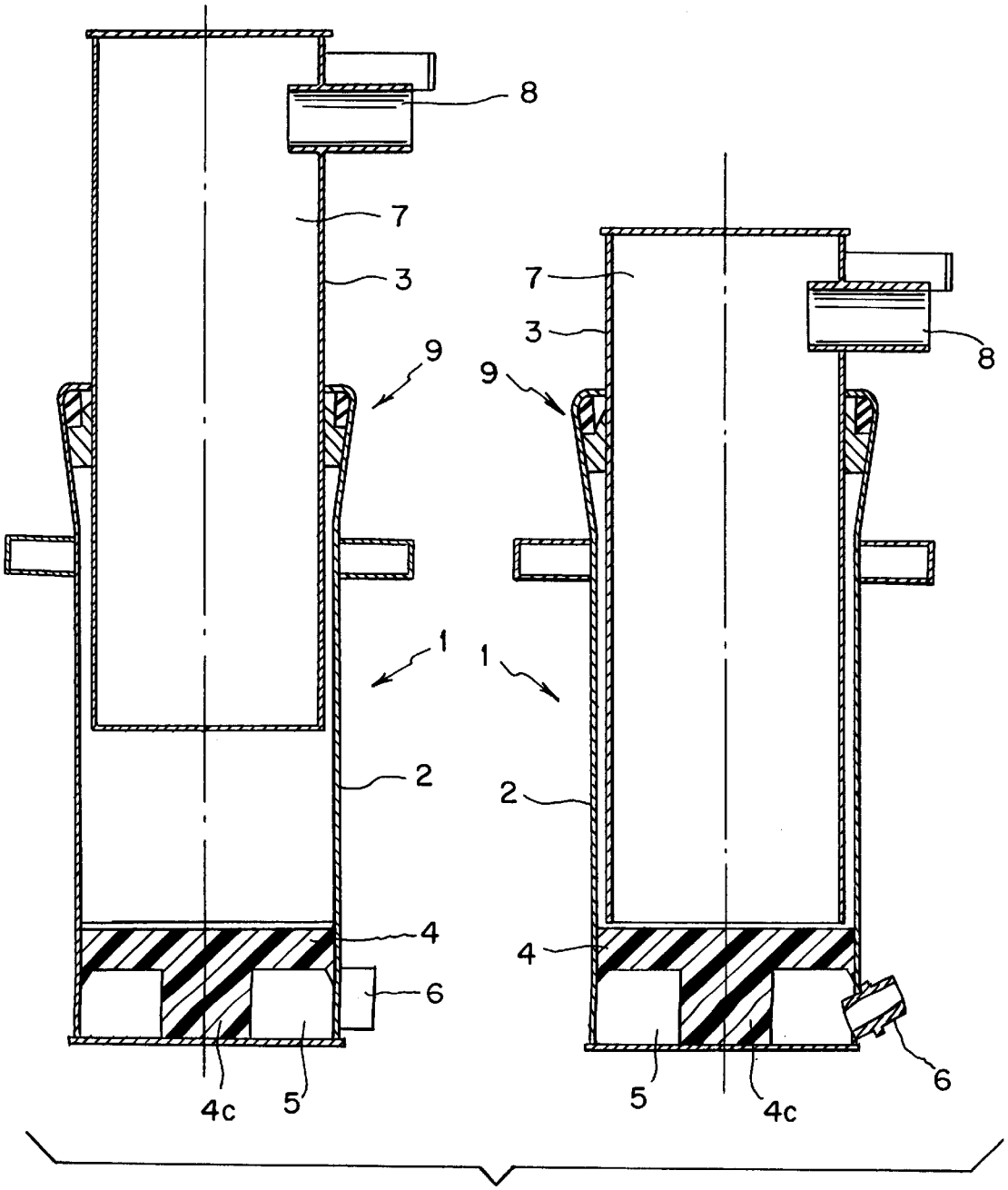
FIG. 17 shows an extending prop according to the invention with a special design of the piston.

In the exemplified embodiment according to FIG. 17, piston 4 has a downwardly protruding elastic projection 4*c* which, after the extending prop has been filled with construction material, abuts the bottom of outer tube 2, providing for elastic support behavior as well.

Figure 18:
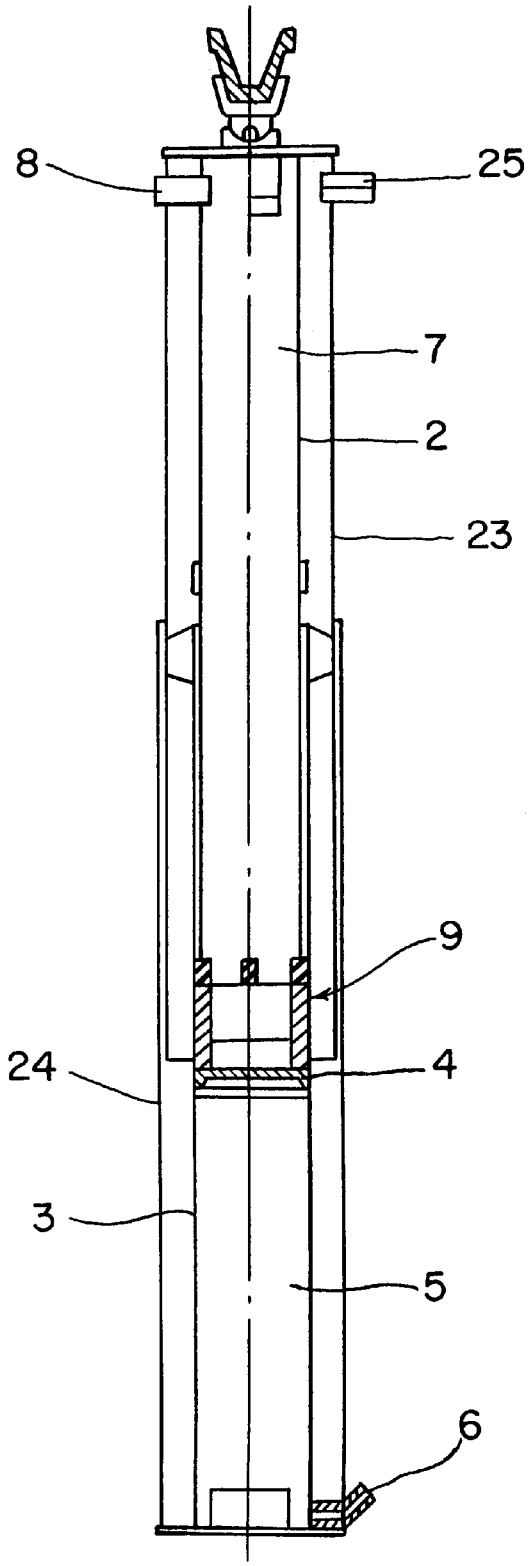
FIG. 18 shows an extending prop according to the invention with a jacketing.

In the exemplified embodiment according to FIG. 18, the extending prop is arranged in the interior of a jacketing consisting of two tubes 23, 24, which are plugged one into the other and guided in the way of a telescope. Said jacketing has a larger diameter than extending prop 1 across its entire length, whereby the annular space between extending prop 2, 3 and jacketing 23, 24 is fillable with construction material via a filling connection 25 arranged on top. As explained above, extending prop 2, 3 arranged in the interior of jacketing 23, 24 can be set with high setting force by hydraulically acting upon piston 4; it can be fixed mechanically with locking device 9, and filled over its total length with construction material by way of filling connection 8. Such extending prop, in combination with the jacketing, has extremely high bearing capacity.

I claim:

1. An extending prop for underground and tunnel construction, comprising:

an outer tube having a closed bottom end;

an inner tube telescopically slidable in said outer tube and having a closed top end;

a mechanical locking device adapted to fix the relative positions of said inner and outer tubes;

a hydraulically actuated flying piston arranged in said outer tube and separated from said inner tube, said piston adapted to extend said inner tube, wherein said piston divides the prop into a bottom chamber enclosed by said outer tube and a top chamber enclosed by said inner tube;

a first filling connection arranged on said outer tube for filling said bottom chamber with a pressure medium; and a second filling connection arranged on said inner tube for filling said top chamber, wherein the prop is fillable with construction material through said second filling connection along its entire length by displacement of said piston toward the bottom end of the the outer tube.

2. Extending prop according to claim 1, characterized in that the mechanical locking device consists of two telescopable ring wedge elements (12, 13) arranged between the bottom end of the inner tube (3) and the piston (4), one (12) of said element being radially expandable during telescoping with plastic widening of the outer tube (2).

3. Extending prop according to claim 2, characterized in that the wedge surfaces of the ring wedge element (12) and/or the counter ring wedge element (13) is/are provided with projections (12*a*) cuttable at a predetermined setting load, said projections releasing displacement of the wedge surfaces against each other only when the predetermined setting load is exceeded.

4. Extending prop according to claim 1, characterized in that the locking device has a ring wedge (10) fixable on the outer circumference of the inner tube (3), said ring wedge being insertable in the outer tube (2) from the top with plastic widening of of the outer tube (2).

5. Extending prop according to claim 4, characterized in that the ring wedge (10) is fitted on its inner circumference with means (11*a*) increasing the friction between the ring wedge (10) and the inner tube (3).

6. Extending prop according to claim 2, characterized in that a ring (22) made of elastically pretensioned material rests against the top side of the ring wedge (10), said ring itself being supported on the top end of the outer tube (2) and pressing the ring wedge (10) downwardly in the axial direction.

7. Extending prop according to claim 1, characterized in that the locking device is designed in the form of an expanding spring ring (11) arranged at the lower end of the inner tube, said spring ring being elastically pretensioned in the radial direction and designed in such a way that it permits a movement of extension of the inner tube (3) relative to the outer tube (2), but spreads in the radial direction during a movement of retraction in such a way that a friction grip and/or positive contact with the outer tube (2) is established.

8. Extending prop according to claim 1, characterized in that the piston (4) consists of elastically and/or plastically yielding material, in particular plastic; that it has an annular lip seal (4*a*) snugly fitting against the wall of the outer tube (2); and that it is mounted on the bottom of a pot-shaped, rigid guiding part (4*b*).

9. Extending prop according to claim 1, characterized in that a pressure-limiting valve is associated with the bottom chamber (5).

10. Extending prop according to claim 1, characterized in that a bursting disk (12) serving as pressure limiter is associated with the bottom chamber (5).

11. Extending prop according to claim 1, characterized in that plastically compressible bodies, in particular in the form of air-filled hollow bodies (14) or foam bodies are arranged in the bottom chamber (5).

12. Extending prop according to claim 1 or any one of the following claims, characterized in that it is fitted with axially compressible spring elements (15) on the foot or head side.

13. Extending prop according to claim 1 or any one of the following claims, characterized in that the wall of the outer tube (2) is provided with bores (18) spaced from the upper end of the outer tube (2) and serving as stroke-limiting means, said bores connecting the bottom chamber (5) with the atmosphere when passed over by the piston (4).

14. Extending prop according to claim 1 or any one of the following claims, characterized in that the walls of the inner tube (3) and outer tube (2) are provided with dewatering bores (19, 20) within the zone of overlapping.

15. Extending prop according to claim 14, characterized in that the dewatering bores (20) of the outer tube (2) are covered by a fabric (21), such fabric being permeable to water but retaining the construction material.

16. Extending prop according to claim 1, characterized in that the outer tube (2) and the inner tube (3) are arranged in the interior of a jacketing consisting of two tubes (23, 24), the latter being plugged one into the other and guided on each other in the way of a telescope, said jacketing having a greater diameter than the extending prop over its entire length, whereby the annular space between the extending prop (2, 3) and the jacketing (23, 24) is fillable with construction material.

* * * * *